United States Patent [19]

Tokuno

[11] 4,010,061

[45] Mar. 1, 1977

[54] PAPER ROLL SPLICING METHOD AND APPARATUS

[75] Inventor: Masatero Tokuno, Nishinomiya, Japan

[73] Assignee: Rengo Co., Ltd., Osaka, Japan

[22] Filed: Apr. 18, 1973

[21] Appl. No.: 352,313

[30] Foreign Application Priority Data

Dec. 16, 1972 Japan ..... 47-126594

[52] U.S. Cl. ..... 156/504; 242/58.3

[51] Int. Cl.[2] ..... B65H 19/16

[58] Field of Search ..... 156/157, 159, 502, 504; 242/58.1, 58.2, 58.3, 58.5, 58.4, 56, 67.3; 24/67 AF

[56] References Cited

UNITED STATES PATENTS

| | | | |
|---|---|---|---|
| 3,195,827 | 7/1965 | Schonerer et al. | 242/58.3 |
| 3,253,795 | 5/1966 | Penrod et al. | 242/58.2 |
| 3,309,036 | 3/1967 | Anderson | 242/58.3 |
| 3,467,334 | 9/1969 | Chesnut et al. | 242/58.3 |
| 3,622,097 | 11/1971 | Maas | 242/58.4 |
| 3,655,143 | 4/1972 | Wallis | 242/58.3 |

*Primary Examiner*—Charles E. Van Horn
*Assistant Examiner*—John E. Kittle
*Attorney, Agent, or Firm*—Stewart and Kolasch, Ltd.

[57] ABSTRACT

The present invention relates to a method and apparatus for splicing paper rolls. More particularly, in a mill roll stand which rotatably supports two paper rolls in faee to face, opposing relationship and which allows the respective position of the two paper rolls to be mutually replaced, the present invention relates to a method and apparatus for splicing the fully wound paper roll, which is not yet pulled out, with paper roll which is being continuously pulled out by correctly combining the respective inside and outside portions of the roll paper.

10 Claims, 20 Drawing Figures

PAPER ROLL SPLICING METHOD AND APPARATUS

BACKGROUND AND SUMMARY OF THE INVENTION

Figure 2:
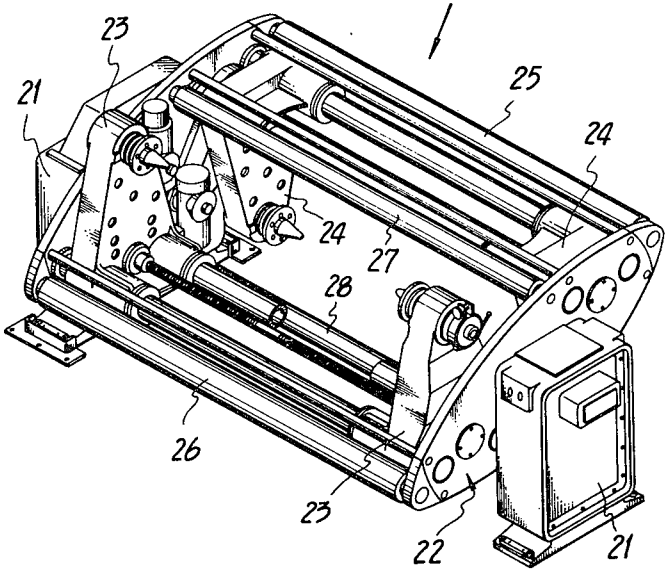

The present invention relates to a method and apparatus for splicing a fully wound paper roll, which is not yet pulled out, with a roll paper, which is being continuously pulled out, among relatively wide, long and heavy paper rolls, by correctly combining the respective side, i.e., inside and outside of the two paper rolls together, and particularly to a method and apparatus for splicing corrugated board liner paper rolls.

Conventionally, in order to splice the paper rolls, paper rolls are respectively hung by a paper roll supporting stand, which can allow the supporting position of an opposing pair of paper rolls to be replaced, as seen in a mill roll stand of the turnover type, in a corrugate machine. The drawing-out speed of one paper roll which is being pulled out is considerably reduced. The other fully-wound paper roll which is not yet pulled out is rotated by one operator's hands, while the winding termination end of the paper roll is held by another operator. The winding termination end is spliced with the paper roll, which is being slowly pulled out, by an adhesive agent or an adhesive tape while correctly combining the respective inside and outside portions of the roll paper. The small remaining portion of the paper roll which had been initially pulled out is cut away after the splicing operation. Thereafter, the newlyspliced paper roll is moved to the drawing-out side of the paper roll by a replacing operation of the paper roll supporting position in the stand. Accordingly, in order to perform this kind of paper roll splicing operation, more time is required.

An object of the present invention is to provide a method and apparatus for splicing paper rolls wherein a fully wound paper roll, which is not yet pulled out is spliced with a paper roll, which is being pulled out, by correctly combining the respective inside and outside portions of the respective paper roll, without reducing the drawing-out speed of the paper roll which is being successively pulled out and without reducing the overall machine operating speed. The older exhausted paper roll can be immediately cut away as part of the paper combining operation.

Figure 1:
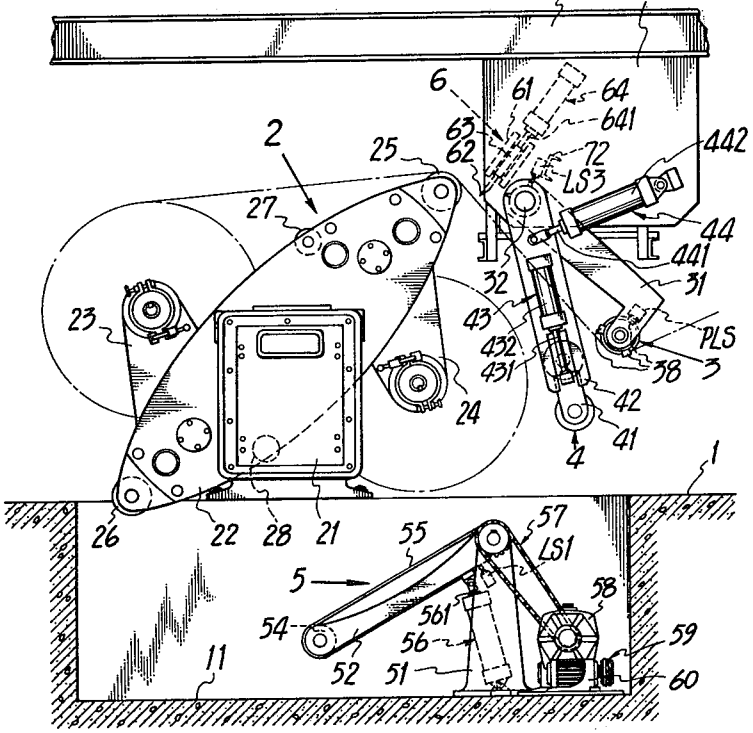
Figure 3:
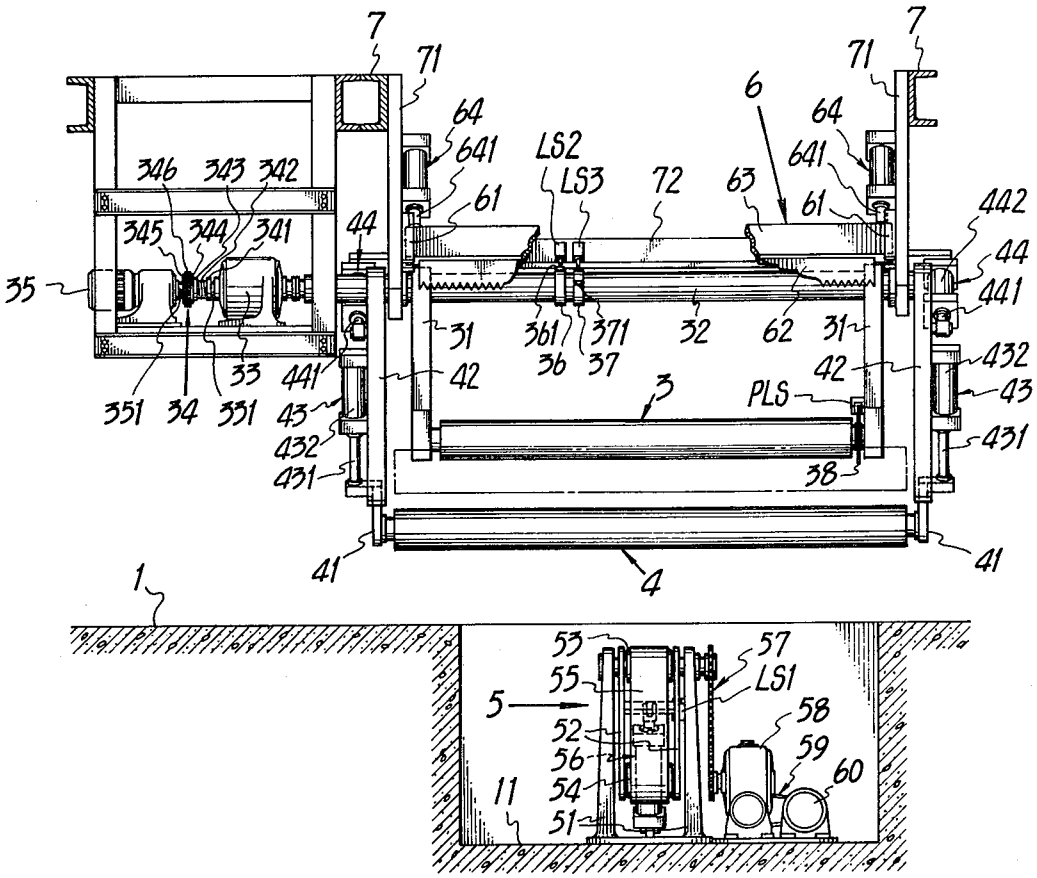
Figure 7:
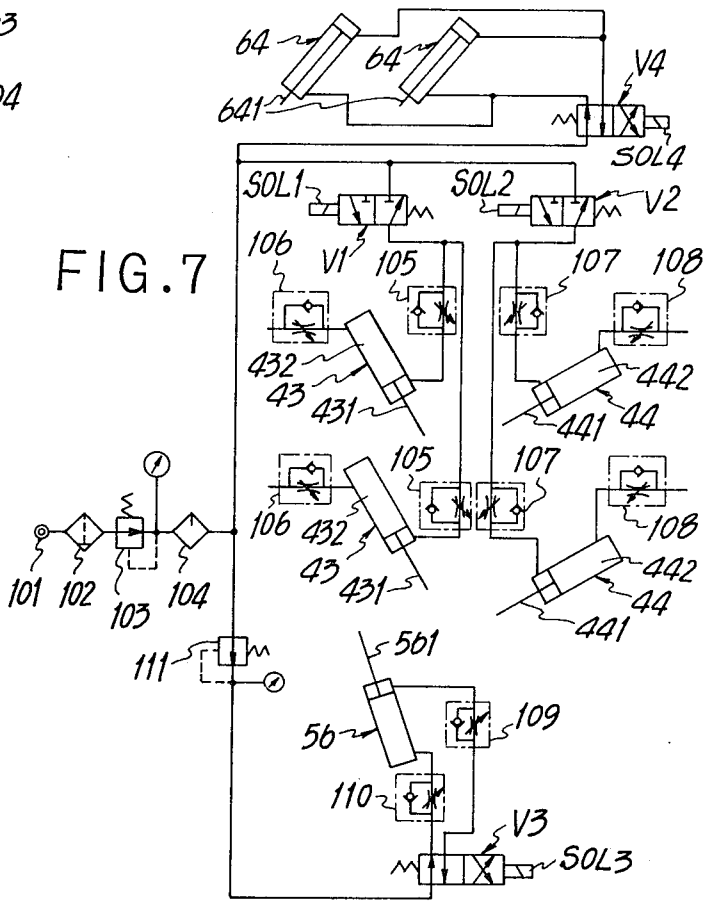
Figure 4:
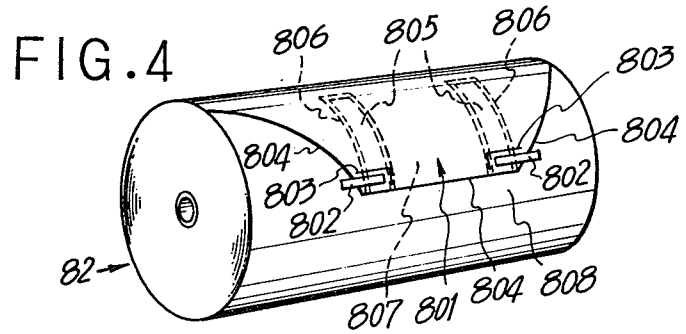
Figure 5:
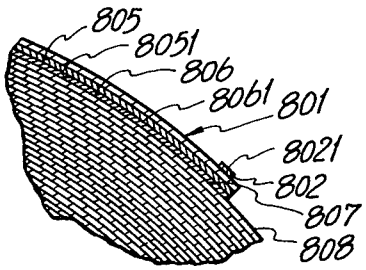
Figure 6:
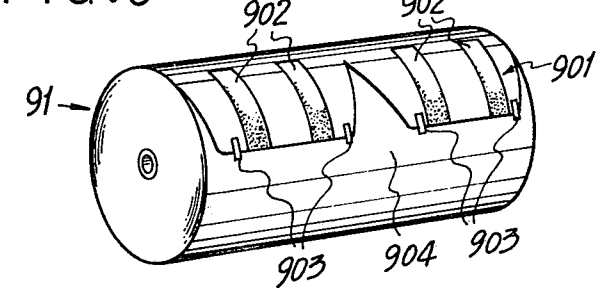
Figure 8:
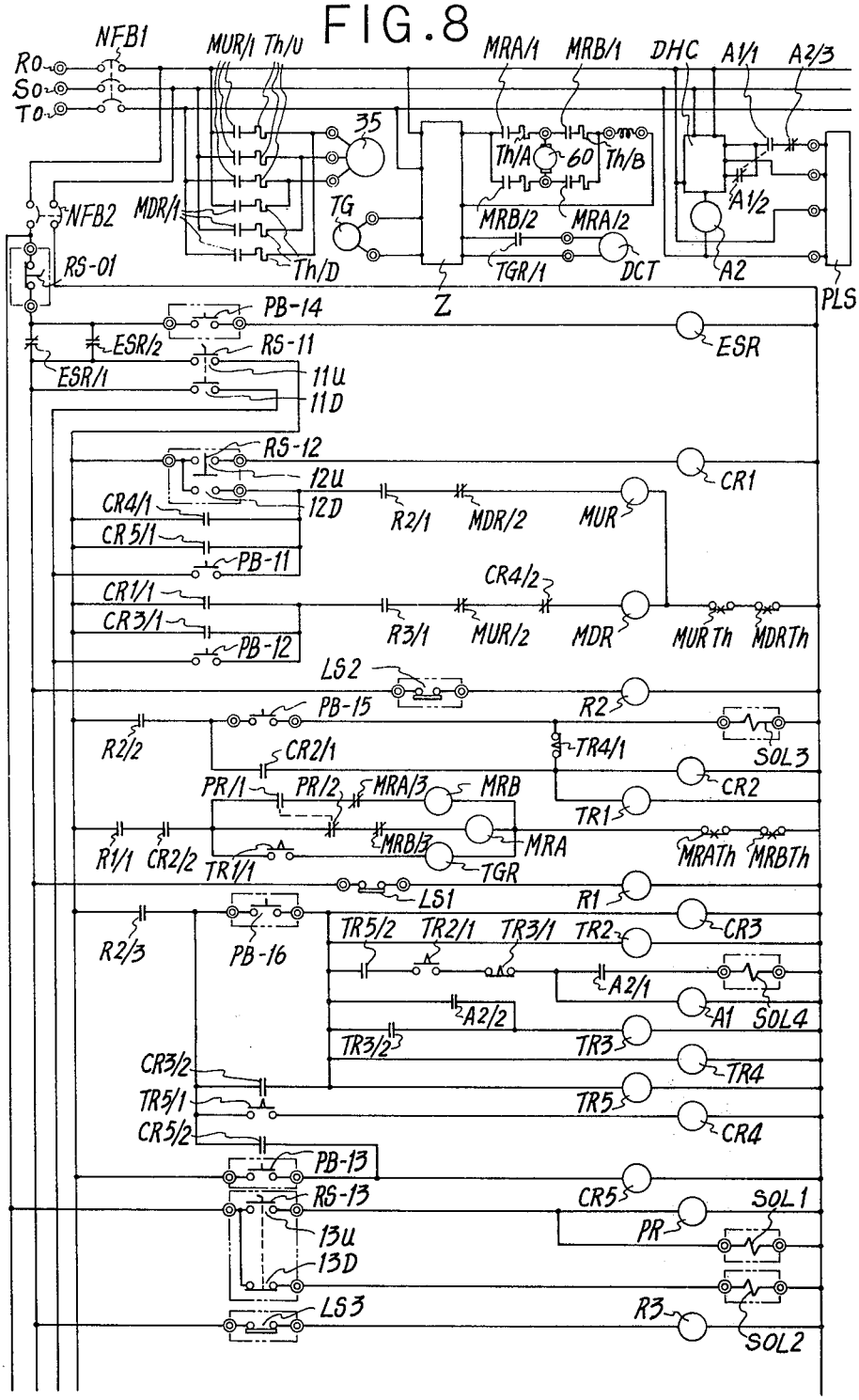

These and other objects and features of the present invention will become apparent from the following full description of the present invention taken in conjunction with the preferred embodiments thereof and with reference to the accompanying drawings, in which;

FIG. 1 is a side view showing a paper roll splicing apparatus in accordance with the present invention, FIG. 2 is a perspective view showing a mill stand in the apparatus of the present invention, FIG. 3 is a front view showing the apparatus of the present invention with the mill roll stand being omitted, and one portion of the cutter being cut out, FIGS. 4 and 5 are respectively, a perspective view and an essential partially enlarged sectional view showing a paper roll to be used in the splicing operation of paper rolls performed by use of an intermediate roll, FIG. 6 is a perspective view showing a paper roll to be used in the splicing operation of the paper rolls performed without the use of the intermediate roll, FIG. 7 is an air-pressure circuit diagram for the paper roll splicing apparatus of the present invention, FIG. 8 is an electric circuit diagram for the paper roll splicing apparatus of the present invention, FIGS. 9 to 14 illustrate the splicing operation of the paper rolls performed by the use of the intermediate roll, and FIGS. 15 to 20 illustrate the splicing operation of the paper rolls performed without the use of the intermediate roll.

The method and apparatus of the present invention will be described hereinafter with respect to a corrugated board manufacturing machine, wherein the paper rolls for the corrugated board liner are spliced with each other by correctly combining the respective inside and outside portion of the respective paper roll.

Figure 9:
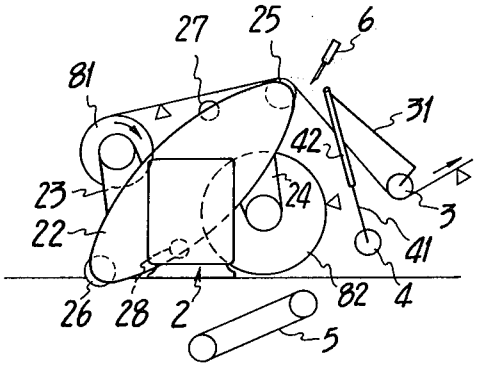

As shown in FIG. 9, paper roll 81 for the corrugated board liner is supported by upward paper roll supporting arms 23 and 23 mounted on the mill roll stand 2 which can face two paper rolls oppositely and support them rotatably, while can replace the mutual position of the supported two paper rolls. The paper being unwound from the paper roll 81 and which has its front face on the outside of the paper roll (the front face faces outwardly the back face thereof being indicated by a Δ mark), passes above the downwardly extending paper roll supporting arms 24 and 24 of the mill roll stand 2 and is successively pulled out from between a paper pushing roll 3 and an intermediate roll 4, which are disposed adjacent to the arms 24 and 24. The roll 81 is rotated in the clockwise direction and the paper pushing roll 3 which is in contact with the paper being withdrawn is also rotated.

The mill roll stand is shown in FIGS. 1 and 2. As apparent from these figures, the mill roll stand 2 has opposing side frames 21 and 21 erected on a base 1. The side frames rotatably hold a rotary frame 22 there between. The rotary frame 22 is provided with a pair of paper roll supporting arms 23 and 23 which can approach toward and separate from each other, and a pair of paper roll supporting arms 24 and 24 which also can approach toward and separate from each other. The supporting arms 24 extend in a direction opposite to that of the arms 23 and 23. Each pair of paper roll supporting arms can rotatably support the respective paper rolls therebetween. Also, under a steady state, as shown in FIG. 1, the rotary frame 22 is suspended with one pair of arms being extended upward and the other pair of arms being extended downward. Also, the rotary frame 22 is rotated counter-clockwise in FIG. 1 by means of a driving means (not shown) built inside the side frame 21, whereby the pair of arms 23 and 23 are replaced, in position, with the pair of arms 24 and 24, and visa cersa.

The rotary frame 22 of the mill roll stand 2 has paper guiding rolls 25 and 26 rotatably mounted at both of its ends. These paper guiding rolls 25 and 26 are located almost symmetrically with respect to the rotating center of the frame 22. Under the condition shown in FIG. 9, the paper roll 81 supported by means of arms 23 and 23 is guided by means of the paper guiding roll 25. Also, the rotary frame 22 of the mill stand 2 has auxiliary paper guiding rolls 27 and 28 mounted rotatably in symmetrical position with respect to the center of rotation of the frame. As apparent from FIG. 14, the paper guiding roll 27 (28) supports and guides the pulled-out paper of the paper roll when the paper roll which is supported by means of upward paper roll supporting arms 23 and 23 (24 and 24) is rotated and pulled out counterclockwise as shown in the drawing.

The paper pushing roll 3, which is covered with elastic rubber 30 on its surfaces, is rotatably mounted at a lower end of a pair of swing arms 31 and 31 as apparent from FIGS. 1 and 3. The upper end of the arms 31 and 31 is fixedly secured to a shaft 32 which is rotatably mounted in plates 71 and 71 suspended from the frames 7 and 7 provided above the mill roll stand 2. An end on the single side of the shaft 32 is connected with a motor 35 through a speed change gear 33 and a torque limiter 34. The normal and reverse rotation of the motor 35 causes a pair of arms 31 and 31 to perform a pendulum motion which allows the paper pushing roll 3 to contact with and separate from the paper roll which is supported by the downward extending pair of arms of the mill roll stand 2.

The torque limiter 34 is so arranged that a disk 341, a coil spring 342, a friction plate 343 and a sprocket 344, which forms a friction face on a face opposite to the friction plate 343, are sequentially engaged with an input shaft 331 of the speed change gear 33. The disk 341 is secured to the shaft 331, one end of the spring 342 is secured to the disk 341, the friction plate 343 is secured to the other end of the spring 342, and the sprocket 344 is rotatably mounted on the shaft 331 so that it will not move axially of the shaft 331, thereby causing the friction plate 343 to be pressed in contact with the friction face of the sprocket 344 by the resilient restoring force of a spring 342. A sprocket 345 which is aligned, in axis, with the sprocket 344 is secured to a shaft 351 of a motor 351 thereby entraining a double-row chain 346, which is made by connecting two endless chains, on the sprockets 344 and 345 to connect the sprocket 344 with the sprocket 345. The application of a load of a given amount upon the shaft 32 upon the rotation of the shaft 32 by driving the motor 35 causes the sprocket 344 and the friction plate 343 to slip thereby to suspending the shaft 32, the arms 31 and 31, and the paper roll 3.

The intermediate roll 4 is a metallic surfaced roll which is disposed between the paper pushing roll 3, and the downward arms 24 and 24 of the mill stand 2. The roll 4 is rotatably mounted by a pair of shaft plates 41 and 41, which are elevatably engaged with the respective lower end of a pair of swing arms 42 and 42. A pair of arms 42 and 42 are provided with a clearance through which the pair of arms 31 and 31 can pass, and are rotatably engaged, respectively, with the shaft 32 at their upper ends. The air cylinders 43 and 43 for vertically moving the intermediate roll are secured to the exterior face of the arms 42 and 42, and the piston rods 431 and 431 thereof are connected with the shaft plates 41 and 41. Under the condition as shown in FIGS. 1, 3 and 9, compressed air pressures are released from each air cylinder 43, and the piston rod 431 of each air cylinder 43 is projected by self-weight from a cylinder tube 432. Thus, the intermediate roll 4 is descended and is located out of the track of the paper pushing roll 3. The retraction of the piston rod 431 of each air cylinder 43 into the tube 432 ascends the intermediate roll 4 thereby locating it within the track of the paper pushing roll 3. Namely, when the intermediate roll 4 is ascended, the distance from the center of the shaft 32 to the center of the intermediate roll 4 is almost equal to the distance from the center of the shaft to the center of the paper pushing roll 3. Furthermore, the piston rods 441 and 441 of the air cylinders 44 and 44 for arm operation, which are rotatably suspended from the outer face of the plates 71 and 71, are rotatably connected with a pair of arms 42 and 42. Under the condition as shown in FIGS. 1, 3 and 9, the piston rod 441 of each air cylinder 44 is retracted into the cylinder tube 442 and a pair of arms 42 and 42 are drawn so as to be away from the mill roll stand As shown in FIG. 9, a paper roll 82 for splicing as shown in FIGS. 4 and 5 is supported by the downward extending arms 24 and 24 of the mill roll stand 2 and its paper roll is pulled out by counter-clockwise rotation as shown in the drawing. The paper roll 82 is a back face-outside winding roll (the back face faces the outside, the back face and is indicated by a Δ mark). The paper roll 82 has a little area of double-face adhesive tapes 802 and 802 applied upon both corners of the outer face of a winding termination end 801. The ears of the roll are cut into an angular form to form a trapezoid as shown in FIGS. 4 and 5. The end of each tape 802 is extended somewhat beyond the winding termination end 801, while the winding termination end 801 is cut deep so that its cut lines 803 and 803 substantially surround the double-face adhesive tape 802 respectively. Also both ends of each cut line 803 approach very close to the winding termination end edge 804. The double-face adhesive tapes 805 and 805 are applied to the inner face of the winding termination end 801, and a single-face adhesive tape 806, whose top face 8061 is treated into a non-binding surface is applied upon the paper roll outer face 807 which faces the unapplied faces 8051 and 8051, whereby a tear-off face is formed. The unapplied face 8051 of each double-face adhesive tape 805 on the inner face of the winding termination end 801 and the top face 8061, which is treated into a non-binding face, of the single face adhesive tape are superimposed. The respective end of the double-face adhesive tapes 802 and 802, which is extended somewhat beyond the winding termination end 801, is applied upon the exterior face 808 of the paper roll adjacent to the winding termination end 801. The single-face adhesive tape 806 is provided with approximately the same area as the both-face adhesive tape 805, or an area somewhat larger than the tape 805. Also, the respective end edge of the double-face adhesive tape 805 and the single-face adhesive tape 806 are almost aligned with the winding termination end edge 804.

Figure 10:
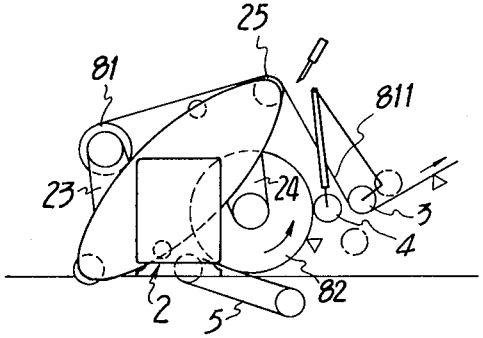

As the paper roll 81 is gradually reduced in size due to its unwinding, the piston rods 431 and 431 of the air cylinders 43 and 43 for vertically moving the intermediate roll are retracted into the cylinder tubes 432 and 432 thereby causing the intermediate roll 4 to ascend to a track or position adjacent the paper pushing roll 3. Also, the compressed air is released from air cylinders 44 and 44 for operating the arms, though not simultaneously with the ascent of the intermediate roll 4, thereby placing the arms 42 and 42 in an inoperative position. When the arms 42 and 42 are placed in an operative position, the intermediate roll 4 is descended by self-weight thereby contacting the paper roll 82 as shown in FIG. 10. At this time, the double-face adhesive tapes 802 and 802 are placed in a position somewhat beyond the intermediate roll 4 by initially rotating the paper roll 82 with the hands so that the double-face adhesive tapes 802 and 802 placed on the outer face of the winding termination end of the paper roll 82 do not contact the intermediate roll 4.

Subsequently, a motor 35 for operating the paper pushing roll 3 is rotated to descend the paper pushing roll 3. As shown in FIG. 10, the roll 3 is pushed against the draw-out portion 811 of the already-pulled-out paper roll 81, thereby approaching the intermediate roll 4 while pulling the portion. Thereafter, said motor 35 is suspended thereby to obtain a splice preparing condition.

However, when the intermediate roll 4 is suspended close to the paper roll 82 without contacting the paper roll 82 and where the paper roll 82 is smaller in diameter than that shown in FIG. 10 and thus the arms 42 and 42 are in an inoperative condition as described hereinbefore, the pulled-out portion 811 is brought into contact with the intermediate roll 4 by pushing the portion 811, drawn from the paper roll 81, by means of the paper pushing roll 3. Thus, the portion 811 is placed immediately near the intermediate roll 4, whereby the splice preparing condition is obtained. Also, when the position of the intermediate roll 4 is somewhat extended from the paper roll 82 where the arms 42 and 42 are in an inoperative condition, the pulled-out portion 811 is brought into contact with the intermediate roll 4 by pushing the pulled-out portion 811 of the paper roll 81 by means of the paper pushing roll 3. Furthermore, the roll 4 is immediately placed in close proximity to the paper roll 82 by pushing the intermediate roll 4 by means of the roll 3 thereby to obtain the splice preparing condition.

As shown in FIG. 10, the splicing preparation is completed. Subsequently, the fully-wound paper roll 82 which is not pulled out yet is temporarily counter-clockwise, as shown in FIG. 10, at the pulling out speed of the paper roll 81 by means of a predriver 5 located in a pit 11 of a foundation 1 disposed below the downward extending arms 24 and 24 of the mill roll stand 2.

As apparent from FIGS. 1 and 3 showing the predriver 5, a driving pulley 53 and an inverted pulley 54 are rotatably fixed to a pulley supporting member 52, whose one end is rotatably fixed to a frame 51 secured in the pit 11. An endless belt 55 is entrained on the pulleys 53 and 54, while a piston rod 561 of an air cylinder 56 rotatably mounted to the pit 11 is rotatably connected with the pulley supporting member 52 thereby allowing the operation of the piston rod 561 to raise the other end of the pulley supporting member 52 so that the endless belt 55 may be placed into contact with and may be separated from the paper roll supported by means of the paper roll supporting arms 24 and 24. The driving pulley 53 is adapted to be rotated, through a V-chain transmission gear 57, a speed change gear 58 and a belt transmission gear 59, by means of a motor 60.

Figure 11:
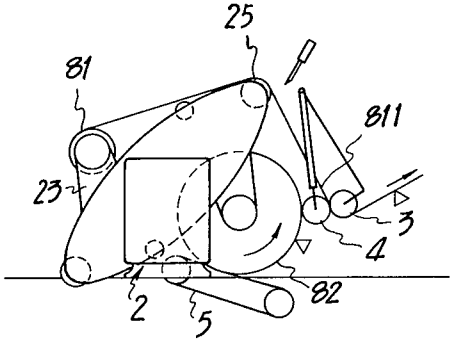

As described hereinabove, the paper roll 82 is rotated by means of the predriver 5. The motor 35 is again rotated at a time when it has been rotated approximately three fourth thereof thereby to cause the paper pushing roll 3 to move further. As shown in FIG. 11, the pulled-out portion 811 of the paper roll 81 is brought into contact with the intermediate roll 4, and the intermediate roll 4 is pushed hard against the paper roll 82. When the intermediate roll 4 is brought into tight contact with the paper roll 82, the unapplied faces 8021 and 8021 of the double-face adhesive tapes 802 and 802 applied on the winding termination end outer face of the paper roll 82, which has been rotated to a position of the intermediate roll 4, is applied to the peripheral surface of the intermediate roll 4. Accordingly, as the winding termination end 801 is wound on the intermediate roll 4 and is inverted, the unapplied faces 8051 and 8051 of the double-face adhesive tapes 805 and 805 on the inner face of the winding termination end 801 are applied upon the pulled-out portion 811 of the paper roll 81. Thus, the paper roll 82 is spliced with the roll paper 81 while correctly combining the respective inside and outside portions of the roll paper, and is pulled out together with the roll paper 81.

When the paper roll 82 is pulled out with the paper roll 81, the double-face adhesive tapes 802 and 802 on the outer face of the winding termination end applied on the intermediate roll 51 are separated from the intermediate roll 4. Or when the tapes 802 and 802 are applied tight on the roll 4, the uncut portion between the respective end of the serrated lines 803 and 803 of the winding termination end 801, and the respective winding termination end edge 804 is broken, whereby the broken pieces of the winding termination end 801 are left on the peripheral surface of the roll 4.

Figure 12:
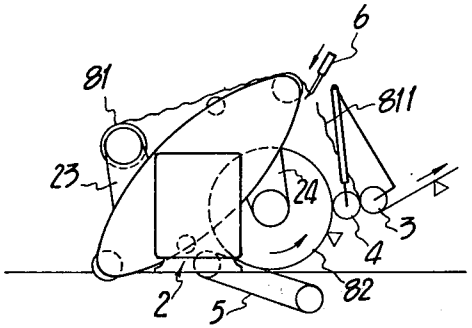

Thus, the paper roll 82 is spliced with the paper roll 81 which is successively pulled out, and thereafter the small-remaining paper roll 81 which is still being pulled out even after the splicing operation is cut away by means of a cutter 6 as shown in FIG. 12.

The cutter 6 is composed as shown in FIGS. 1 and 3. Namely, frames 61 and 61 on which a tool rest can slide vertically are mounted on the inner face of the plates 71 and 71 above the mill roll stand 2. The tool rest 63 has a knife 62 which has a blade which is somewhat larger than the width of the paper roll and is engaged with the frames 61 and 61, and the piston rods 641 and 641 of the air cylinders 64 and 64 which in turn are secured to the inner face of each plate 71 and 71 which are connected with the tool rest 61. The knife 62 is projected, by operation of the air cylinders 64 and 64, thereby cutting the paper from the expired roll 81, immediately after the drawn out end has past the paper guiding rolls 25 and 26, of the paper roll.

Figure 13:
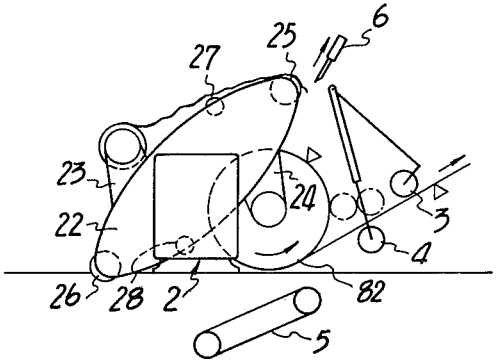
Figure 14:
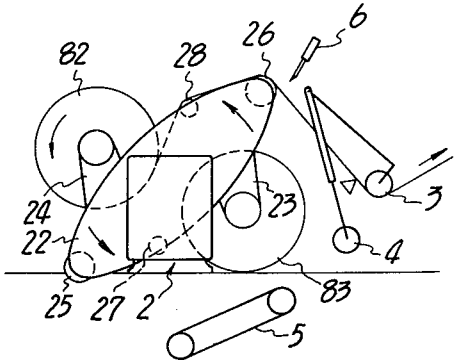

The paper roll 81 is cut from the operation by means of a cutter 6, whereby the paper roll splicing operation is finished. Thereafter, as shown in FIG. 13, the paper pushing roll 3, the intermediate roll 4, the predriver 5 and the cutter 6 are restored to their initial position. Then, the next paper roll 83 to be used is maintained on the arms 23 and 23, which have been emptied, and thereafter the rotary frame 22 is rotated counter-clockwise in the drawing to exchange the position of the arms 23 and 23 with the arms 24 and 24, as shown in FIG. 14, whereby a subsequent splicing operation can be eventually achieved. The paper roll 82 is guided by means of an auxiliary paper guiding roll 28 and a paper guiding roll 26, which are respectively mounted on the rotary frame 22, the paper from said paper roll being successively pulled out to the following process.

A splicing operation will now be described wherein a winding paper roll 91 with the front face facing the outside is spliced with a front face-exposed winding paper roll 81, which is supported by means of an upward extending paper roll supporting arms 23 and 23 of the mill roll stand 2 and is successively being pulled out.

Figure 15:
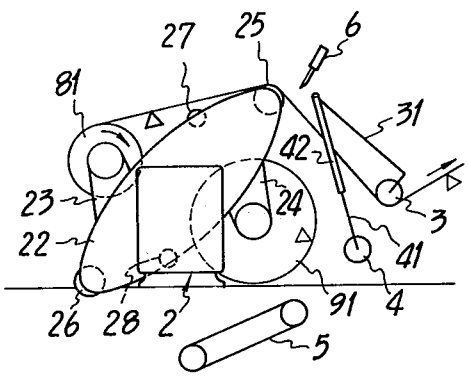
Figure 16:
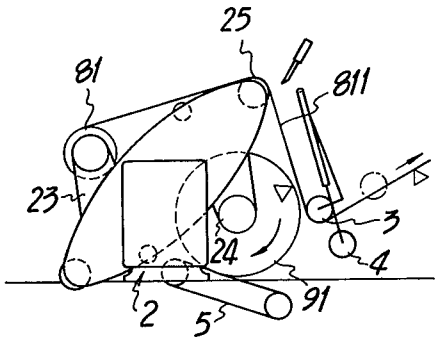
Figure 17:
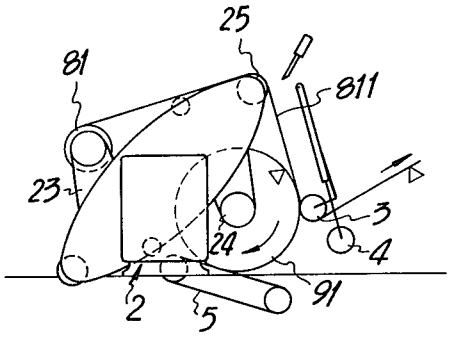
Figure 18:
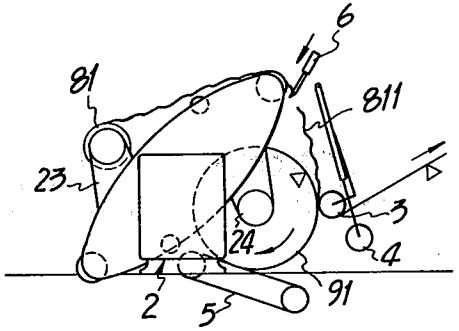
Figure 19:
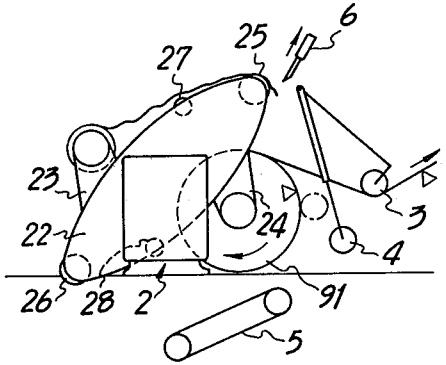
Figure 20:
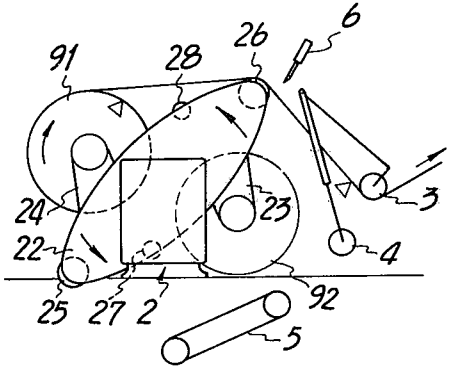

As shown in FIG. 6, both-face adhesive tapes 902, are applied upon the outer face of the winding termination end 901 of the paper roll 91, while double-face adhesive tapes 903, are applied on the winding termination end 901 and the outer face 904 of the paper roll adjacent thereto, thereby temporarily retaining the winding termination end 901 on the outer face 904 of the paper roll. As shown in FIG. 15, the paper roll 91 is supported by means of the downward extending paper roll supporting arms 24 and 24 of the mill roll stand 2 as shown in FIG. 15, and is rotated in the counter-clockwise direction as shown in the drawing for achieving the pull-out operation. Subsequently, the motor 35 for operating the paper pushing roll is rotated thereby causing the paper pushing roll 3 to descend. As shown in FIG. 16, the roll 3 is pushed against the pulled-out portion 811 of the paper roll 81 and is descended in close proximity to the paper roll 91, while the portion 811 is being continuously pulled out. Then, the motor 35 is suspended. Subsequently, the paper roll 91 is rotated clockwise as shown in the drawing while being set to the pulling-out speed of the paper roll 81 by means of the predriver 5. Thereafter, the motor 35 is rotated again thereby causing the paper pushing roll 4 to approach the paper roll 91 and causing the pulled-out portion 811 of the paper roll 81 to contact the paper roll 91 as shown in FIG. 17. The respective unapplied faces of the double-face adhesive tapes 902, and 903, which have been applied to the winding termination end 901 of the paper roll 91 are then applied to the pulled-out portion 811 causing the winding termination end 901 to be spliced with the paper roll 81 by correctly combining the respective inside and outside portions of said paper rolls, whereby the paper roll 91 is pulled out together with paper roll 81. Thereafter, as shown in FIG. 18, the small-remaining portion of the paper roll 81 is cut away by means of cutter 6, thus completing the paper roll splicing operation. Then, as shown in FIG. 19, the paper pushing roll 3, the predriver 5 and the cutter 6 are restored to their original position. Additionally, the next paper roll 92 is placed on the arms 23 and 23, which have just been emptied, and the rotary frame 22 is rotated counter-clockwise in the drawing to replace the position of the arms 23 and 23 with the arms 24 and 24, in terms of a position, as shown in FIG. 20, whereby preparation for the next splicing operation is achieved.

Air pressure circuits concerning the air cylinders 43 and 43 for vertically elevating the intermediate roll, air cylinders 44 and 44 for operating the arms, air cylinder 56 for the predriver 5 and air cylinders 64 and 64 for the cutter 6 in the above-mentioned paper roll splicing apparatus are shown in FIG. 7.

Referring now to FIG. 7, VI and V2 are respectively a three-port two-position solenoid-operated valve, while V3 and V4 are respectively a four-port two-position solenoid-operated valve. A feed-air port for the solenoid-operated valves V1, V2 and V4 is pipe-connected to a proper compressed air source 101 through a filter 104, a discharge regulating valve 103 with a pressure gauge, and a lubricator 102. Also, another discharge regulating valve 111 with a pressure gauge is connected between the solenoid-operated valve V3 and the filter 104. A port on the cylinder side of the valve V1 is pipe-connected to a port on the rod cover side of the air cylinders 43 and 43 through speed controllers 105 and 105, while a port on the head cover side of the air cylinders 43 and 43 is communicated with the atmosphere through speed controllers 106 and 106. A port on the cylinder side of the valve V2 is pipe-connected to a port on the rod cover side of the air cylinders 44 and 44 through speed controllers 107 and 107, while a port on the head cover side of the air cylinders 44 and 44 is communicated with the atmosphere through speed controllers 108 and 108. A port on the cylinder side of the valve V3 is pipe-connected to the air cylinder 56 of the predriver through speed controllers 109 and 110, while a port on the cylinder side of the valve V4 is pipe-connected to air cylinders 64 and 64. Under the condition as shown in FIG. 7, a solenoid SOL 1 of the valve V1, and a solenoid SOL 2 of the valve V2 are respectively demagnetized, the piston rods 431 and 431 of the air cylinders 43 and 43 are projected from the cylinder tubes 432 and 432 by self-weight and the intermediate roll 4 is in a descended position. The piston rods 441 and 441 of the air cylinders 44 and 44 are freely retractable into the cylinder tubes 442 and 442, the arms 44 and 44 being respectively in an idle position. The excitation of the solenoid SOL 1 retracts the piston rods 431 and 431 into the cylinder tubes 432 and 432 thereby raising the intermediate roll 4. The excitation of the solenoid SOL 2 retracts the piston rods 441 and 441 into the cylinder tubes 442 and 442 thereby separating the arms 42 and 42 from the mill roll stand 2. Also, under the condition as shown in FIG. 7, the solenoid SOL 3 of the valve V3 and the solenoid SOL 4 of the valve V4 are respectively demagnetized, and the piston rod 561 of the air cylinder 56 is retracted into the cylinder tube and thus the pulley supporting member 52 of the predriver 5 is in a descended position. The piston rods 641 and 641 of the air cylinders 64 and 64 are retracted into the cylinder tube and accordingly the knife 62 of the cutter 6 is retracted up to its ascent limit. The excitation of the solenoid SOL 3 projects the piston rod 561 thereby raising the pulley supporting member 52, while the excitation of the solenoid SOL-4 projects the piston rods 641 and 641 thereby projecting the knife 62.

The electric circuits for the paper roll splicing apparatus described hereinbefore is shown in FIG. 8. Referring now to FIG. 8, a three-phase AC motor 35 is required for vertically moving the paper pushing roll. NFB 1 and NFB 2 are respectively a triod no-fuse breaker and a diode no-fuse breaker. NFB 1 is designed to turn on and off a main circuit the power leading-in from power leading terminals R0, S0 and T0, and ( or ) to protect a secondary side load circuit, while NFB 2 is designed to turn on and off the feeding operation to an operating circuit for a control board of the present apparatus, namely, the secondary side load circuit, and ( or ) to protect the operating circuit. A DC motor 60 is used for the predriver 5. A ratio controlling device Z operates, through proportional controlling, the motor 60 by input from a motor DCT which detects the drawing-out speed of the paper roll from the mill roll stand 2, and input from a tachometer generator TG which directly detects the rotation speed of the motor 60 for feedback controlling, preparatorily rotates and drives the fully-wound paper roll, which is to be spliced and is not yet pulled out by setting its speed to the drawing-out speed of the paper roll. DHC is a digital counter which counts pulse inputs from a proximity switch PLS. A2 is a relay which is excited upon expiration of a set counted value for the digital counter DHC. The proximity switch PLS is fixed to an arm 31 by which the paper pushing roll 3 is suspended. Vanes 38, 38 and 38 mounted radially on the shaft of the roll 3 are rotated with the rotation of the roll 3 thereby transmitting a pulse whenever approaching the switch PLS. RS - 01, RS - 11 and RS - 13 are respectively a switch of the rotary type, and the opening condition and closing condition of contact can be maintained by proper rotation and suspension of a switch handle. Also, RS - 12 is also the switch of a rotary type. It is a rotary switch wherein the two contacts are normally open, either one of the contacts being closed only when the condition is retained, with hands, by rotating the switch handle. The switch RS - 01 is designed for the apparatus operation, and apparatus lock switching, whereas the switch RS - 11 is designed for auto-manual operation switching. The switch RS - 12 is designed for the splice preparing operation and for the slight motion ascent operational switching of the paper pushing roll 3, while the switch RS - 13 is designed for the operation of the intermediate roll 4. PB - 11, PB - 12, PB - 13, PB - 14, PB - 15 and PB - 16 are respectively so-called momentary push-button switches which are closed only when the switch knobs are in a depressed position. The switch PB - 11 is a manually operated switch for rotating the motor 35 in a direction along which the paper pushing roll 3 is raised, while the switch PB - 12 is a manually operated switch for rotating the motor 35 in a direction along which the paper pushing roll 3 is lowered. The switches PB - 13 and PB - 14 are respectively provided for resetting and for emergency stopping while the switches PB - 15 and PB - 16 are respectively provided the for predriver operation, and for starting the splice operation. LS1, LS2 and LS3 are respectively a normally closed contact for limit switches. As apparent from FIGS. 1 and 3, the limit switch LS1 is secured to the frame 51 of the predriver which is fixedly provided in a pit 11. The limit switch LS1 is opened through the pushing force of the supporting member 52 when the pulley supporting member 52 is located at its descent limit, and is closed when the pulley supporting member 52 is ascended from the descent limit. As apparent from FIGS. 1 and 3, the limit switches LS2 and LS3 are secured to a supporting rod 72 bridged between plates 71 and 71 suspended from the frames 7 and 7 above the mill roll stand 2, and are directed towards the shaft 32. Rings 36 and 37 with projection are fixedly engaged with the shaft 32 in response to the limit switches. The limit switch LS2 is opened by the pushing force of a projection 361 of the ring 36 when the paper pushing roll 3 is located at its upper limit, and is closed when the paper pushing roll 3 is descended from its top limit. The limit switch LS3 is opened by the pushing force of a projection 371 of the ring 37 when the roll 3 has reached its bottom limit in the inspection operation, etc. of the apparatus, and is closed when the roll 3 is not in its bottom limit.

MUR, MDR, MRA and MRB are respectively an operating coil for magnetic contactors. Contactors MUR and MDR are respectively intended for ascending and descending the arms 31 and 31, while the contactors MRA and MRB are respectively designed for normally and reversely rotating the motor 60 of the predriver. ESR, R1, R2, R3, CR1, CR3, CR4, CR5, PR, A1, A2 and TGR are relay coil. The relay ESR is for emergency stopping. Relays R1, R2 and R3 are respectively auxiliary relays for limit switches which are excited when the limit switches LS1, LS2 and LS3 are respectively in a closed position. The relays CR1, CR2, CR3, CR4, CR5, PR, A1, A2 and TGR are relays for sequentially controlling the paper roll splicing flow. TR1, TR2, TR3, TR4, and TR5 are respectively coils for timer relays. The timer relay TR1 is for the rotational start timing of the motor 60 of the predriver, the timer relay TR2 is for the count start time limit setting by a counter DHC; the timer relay TR3 is for the descent time limit setting of the cutter knife 62; the time relay TR4 is for the return descent timing of the pulley supporting member 52 of the predriver; the timer relay TR5 is for the ascent timing of the arms 31 and 31. SOL1, SOL2, SOL3 and SOL4 are respectively a solenoid coil for solenoid-operated valves shown in the air pressure circuit diagram (see FIG. 7). MUR/1 and MDR/1 are respectively a normally-opened contact for magnetic connectors MUR and MDR. The normally-opened contact is referred to as an A contact hereinafter. MRA/1 and MRA/2 are respectively the A contact for a contactor MRA, while MRB/1 and MRB/2 respectively are the A contact for a contactor MRB. R1/1 is the A contact for R1. R2/1, R2/2 and R2/3 are respectively the A contact for the relay R2. R3/1 is the A contact for the relay R3. Also, CR1/1 is the A contact for the relay CR1, CR2/1 and CR2/2 being respectively the A contact for the relay CR2, CR3/1 and CR3/2 being respectively the A contact for the relay CR3, CR4/1 being the A contact for the relay CR4, CR5/1 and CR5/2 bing respectively the A contact for the relay CR5, PR/1 being the A contact for the relay PR, A1/1 being the A contact for the relay A1, A2/1 and A2/2 being respectively for the relay A2, and TGR/1 being the A contact for the relay TGR. MUR/2, MDR/2, MRA/3 and MRB/3 are respectively a normally-closed contact for magnetic contactors MUR, MDR, MRA and MRB. The normally-closed contact is referred to as a B contact hereinafter. ESR/1 and ESR/2 are respectively the B contact for the relay ESR, CR4/2 is the B contact for the relay CR4, PR/2 is the B contact for the relay PR, A1/2 and A2/3 is respectively the B contact for the relays A1 and A2. TR1/1, TR2/1 and TR5/1 are respectively a time limit operating A contact for the timer TR1, the timer TR2 and the timer TR5, and are respectively closed after the elapse of a set time after the timer relay has been excited. TR3/1 and TR4/1 are respectively the time limit operating B contact for the timer relays TR3 and TR4 and are opened after the elapse of the set time after a timer relay has been excited. TR3/2 and TR5/2 are, respectively, a momentarily operating A contact for the timer relay TR3 and TR5 and are closed immediately after the timer relay has been excited. Th/U and Th/D are respectively a thermal relay and are used for protection of the motor 35 from overload. B contacts MURTh and MDRTh are the B contact for the respective thermal relays and are opened when the respective thermal relays have been operated. Th/A and Th/B are, respectively, a thermal relay for the protection of the motor 60 from overload for the predriver. B contacts MRATh and MRBTh are the contact for the respective relays and are opened when the thermal relay has been operated.

Subsequently, the functioning condition of the electric circuits will be schematically described in a case where the full wound paper roll, which is not pulled yet is spliced with the paper roll, which is being successively pulled out, by use of the intermediate roll 4 as shown in FIGS. 9 to 14. Assume that a switch RS - 01 for unit locking is closed, and a switch RS - 11 for automatic operation to manual operation switching has an automatic operation contact 11U which is closed.

Under a steady condition as shown in FIG. 9, a switch RS - 13 for intermediate roll operation has its contact 13U opened and its contact 13D closed with a solenoid SOL1 being demagnetized and a solenoid SOL2 being excited. Accordingly, the intermediate roll 4 is in a descended position, while swing arms 42 and 42 are separated away from the mill roll stand 2. Also, the paper pushing roll 3 is suspended at its top limit. The limit switch LS2 is opened, while the limit switch LS3 is closed. Furthermore, the predriver 5 is stopped when the pulley supporting member 52 is at its descent limit. Accordingly, the limit switch LS1 is opened, and also the cutter 6 is suspended with the knife 62 being in a descended position.

From such a steady condition, the contact 13U for the switch RS - 13 is closed and the contact 13D therefor is opened. The solenoid SOL1 is excited, while the solenoid 2 is demagnetized. As apparent from FIG. 7, the piston rod 431 of each air cylinder 43 is ascended to raise the intermediate roll 4, while the piston rod 441 of each air cylinder 44 is adapted to be freely engaged into and disengaged from the cylinder tube 442. The arms 442 and 42 are placed in inoperative condition and thus the intermediate roll 4 is descended by its own-weight thereby contacting the paper roll 82 as shown in FIG. 10.

Subsequently, closure of the contact 12U the splice preparing operation of the switch RS - 12 excites the magnetic contactor MDR thereby starting the rotation of the motor 35. Accordingly, the swing arms 31 and 31, and the paper pushing roll 3, begin to descend. As the paper pushing roll 3 is descended in close proximity to the intermediate roll 4 and the portion 811 of the paper roll which is being pulled out approaches the intermediate roll 4 as shown in FIG. 10, the contact 12U is opened by releasing the hand off switch RS - 12. The magnetic contactor MDR is demagnetized to cause the motor 35 and paper pushing roll 3 to be suspended.

By pushing the switch PB - 15 for the predriver operation, the solenoid SOL 3 is excited thereby projecting the piston rod 561 of the air cylinder 56 to cause the pulley supporting member 52 of the predriver to ascend. The limit switch LS1 which has been open is closed by raising the pulley supporting member 52. Also, by pushing the switch PB - 15, the relays MRB and TGR are excited together with the ascent of the supporting member 52 thereby closing the contacts MRB/1, MRB/2 and TGR/1. Accordingly, the motor 60 is rotated so that the endless belt 55 of the predriver rotates the paper roll 82 counter-clockwise as shown in FIG. 10, while setting it to the drawing-out speed of the paper roll 81.

Subsequently, by pushing the switch PB - 16 for starting the splicing operation, the magnetic contactor MDR is again excited, thereby to rotating the motor 35 to cause the paper pushing roll 3 to bring the paper roll portion 811 into contact with the intermediate roll 3 as shown in FIG. 11. Also, by pushing the switch PB - 16, the timer relays TR2 and TR5 are excited and subsequently the time limit operating A contact TR2/1 of the timer relay TR2 is closed thereby to exciting the relay A1. Accordingly, the contact A1/2 of the relay A is opened, while the contact A1/1 is closed, whereby the proximity switch PLS and the counter DHC are connected with each other. The proximity switch transmits a pulse every time the vanes 38, of the end of the paper pushing roll 3, which is rotated by the pulling-out operation of the paper roll, pass near the proximity switch PLS, and the counter DHC counts the pulse inputs. The relay A2 is excited upon reaching of the counter DHC to a set counted value. The time required for the counter to reach the set counted value is long enough to complete the splicing operation of the paper roll 81 with the paper roll 82. The excitement of the relay A2 closes the contact A2/1 thereby exciting the solenoid SOL4. As shown in FIG. 12, the piston rod 641 of each air cylinder 64 is projected thereby to project the cutter knife 62, whereby the paper roll 81 is cut. After the roll paper 81 has been cut, the limit operating B contact TR3/1 of the timer relay TR3 is opened thereby to demagnetizing the solenoid SOL4 and the cutter knife is ascended to retracted. Also, after the paper roll 81 has been cut, the time limit operating A contact TR5/1 of the timer relay TR5 is closed thereby exciting the relay CR4. Accordingly, the magnetic contactor MDR is demagnetized and the magnetic contactor MUR is simultaneously excited. The motor 35 is counter-rotated to raise the paper pushing roll 3. The limit switch LS2 is opened when the roll 3 reaches its top limit, and the contactor MUR is demagnetized thereby to suspending the motor 35. Also, after the splicing operation of the paper rolls has been completed, the time limit operating B contact TR41 of the timer relay TR4 is opened thereby demagnetizing the solenoid SOL3, whereby the pulley supporting member 52 of the predriver 5 is lowered. The limit switch LS1 is opened upon reaching of the pulley supporting member 52 to its lowered limit, and accordingly, the relay R1, the contactor MRB and the relay TGR are demagnetized thereby to suspending the motor 60.

Thus, the contact 13U of the intermediate roll operating switch RS - 13 is opened, while the contact 13D is closed. The intermediate roll 4 is descended, and the arms 42 and 42 are separated from the mill roll stand 2, whereby a steady condition is reestablished.

As shown in FIGS. 15 to 20, in splicing the paper roll 91 with the roll paper 81 without employing the intermediate roll 4, the intermediate roll operating switch RS - 13 sequentially operates the splice preparing switch RS - 12, the predriver operating switch PB - 15 and the splice starting switch PB - 16, with its contact 13U opened and its contact 13D closed. In this case, the motor 60 for the predriver 5 is rotated to allow the paper roll 91 to be rotated clockwise as shown in FIG. 16.

Even in any splicing operation shown in FIGS. 9 to 20, the paper pushing roll 3, the predriver 5 and the cutter 6 are returned to a steady condition by pressing the resetting switch PB - 13. By pressing the switch PB - 14 for an emergency stop, the motors 35 and 60 are suspended, and solenoids SOL3 and SOL4 are demagnetized. Thus, the predrivers 5 and the cutter 6 are returned to a steady position. Furthermore, the closure of the contact 12D of the switch RS - 12 can cause the paper pushing roll 3 to be raised through a slight motion, if the roll 3 is below its top limit, but is not descending. The roll 3 can be raised and lowered by properly closing the switch PB - 11 and PB - 12, with the manual operating contact 11D of the switch RS - 11 for automatic to manual operation switching.

The invention being thus described, it will be obvious that the same may be varied in many ways. Such variations are not to be regarded as a departure from the spirit and scope of the invention, and all such modifications are intended to be included within the scope of the following claims.

What I claim is:

1. An apparatus for splicing a leading end of a fully wound web roll, which has not yet been unwound, with a web running from an exhausting web roll which is being continuously unwound, comprising:

a mill roll stand which contains opposing side frames, a rotary frame rotatably mounted between said opposing side frames, said rotary frame being provided with means for rotatably mounting said fully-wound web roll and said exhausting web roll in a mutually opposing relationship, means for rotating the rotary frame to place the fully-wound web roll in the splicing position and the exhausting web roll in the unwinding position;

web guiding means disposed on the rotary frame for guiding the web from the exhausting web roll placed in the unwinding position;

means for rotating, up to the speed of the running web, the fully wound web roll which is placed in the splicing position prior to the splicing operation;

a web pushing roll provided near the fully-wound web roll placed in the splicing position, the web pushing roll being rotatably supported by a pair of arms pivotally suspended from a stationary member disposed above the mill roll stand, and being adapted to move toward and away from the fully-wound web roll while guiding the web from the exhausting web roll on a portion of the web pushing roll surface facing toward the fully-wound web roll;

an intermediate roll disposed between the fully-wound web roll placed in the splicing position and the web being guided on the surface of the web pushing roll, said intermediate roll being rotatably supported by a pair of arms which are pivotally suspended from said stationary frame so as not to interfere with the movement of said pair of arms supporting the web pushing roll, said pair of arms supporting said intermediate roll being adapted to be shortened and lengthened so as to place the intermediate roll into and out of the path of the motion of the web pushing roll;

means for moving the arms supporting the web pushing roll to push the running web by said web pushing roll toward the fully-wound web roll placed in the splicing position or to push the intermediate roll toward the fully-wound web roll with the running web interposed between the web pushing roll and the intermediate roll placed in the path of the web pushing roll; and means for cutting the running web from the exhausting roll.

2. The apparatus of claim 1, wherein web guiding means are disposed on the rotary frame between the exhausting web roll and the pushing roll for guiding the web which is being drawn from said exhausting web roll.

3. The apparatus of claim 2, wherein the web guiding means are guiding rolls.

4. The apparatus of claim 2, wherein the rotary frame is eliptical in shape and the web guide means are disposed at the extreme end portions of said rotary frame.

5. The apparatus of claim 4, wherein the exhausting web roll and the fully wound web roll are rotatably mounted on supporting arms which extend in substantially opposite directions from the opposite sides of said rotary frame.

6. The apparatus of claim 1, wherein the means for rotating the fully wound web roll comprises a conveyor belt, means for rotating the conveyor belt and means for moving the surface of the conveyor belt into and out of contact with the surface of the fully wound web roll.

7. The apparatus of claim 1, wherein the cutting means comprises a blade which is wider than the width of the web and means for projecting the blade to a cutting position and retracting the blade from the cutting position.

8. The apparatus of claim 2, wherein the web cutting means is disposed between the web guide means and the pushing roll.

9. The apparatus of claim 1, wherein the fully wound web roll is provided with at least one first double-faced adhesive tape on the inner face of its leading free end portion, said first double-faced adhesive tape being detachably superimposed on the outer face of the fully wound web roll, and at least one second-double-faced adhesive tape extending from the outer face leading free end portion of the fully wound web roll onto the outer face of the fully wound web roll.

10. The apparatus of claim 9, wherein said second-double-faced adhesive tape is positioned in tear-away portions of the free end of said fully wound web roll.

* * * * *